US011353203B2

(12) United States Patent
Peng et al.

(10) Patent No.: US 11,353,203 B2
(45) Date of Patent: Jun. 7, 2022

(54) LIGHTING APPARATUS WITH MANUAL SWITCH

(71) Applicant: XIAMEN LEEDARSON LIGHTING CO., LTD, Fujian (CN)

(72) Inventors: Wenjin Peng, Fujian (CN); Lei Zhang, Fujian (CN); Chunteng Chen, Fujian (CN); Jiadong Chen, Fujian (CN); Junjie Lin, Fujian (CN); Shaomei Liang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 16/991,491

(22) Filed: Aug. 12, 2020

(65) Prior Publication Data

US 2021/0317975 A1 Oct. 14, 2021

(51) Int. Cl.

| | |
|---|---|
| ***F21V 23/04*** | (2006.01) |
| ***F21V 23/00*** | (2015.01) |
| ***F21S 9/02*** | (2006.01) |
| ***F21V 17/10*** | (2006.01) |
| ***F21V 7/00*** | (2006.01) |
| *F21Y 105/18* | (2016.01) |
| *F21Y 115/10* | (2016.01) |

(52) U.S. Cl.

CPC ..... *F21V 23/0435* (2013.01); *F21S 9/02* (2013.01); *F21V 7/0066* (2013.01); *F21V 17/104* (2013.01); *F21V 23/003* (2013.01); *F21Y 2105/18* (2016.08); *F21Y 2115/10* (2016.08)

(58) Field of Classification Search

CPC .. F21V 23/0435; F21V 23/003; F21V 17/104; F21V 7/0066; F21S 9/02; F21Y 2105/18; F21Y 2115/10

See application file for complete search history.

(56) References Cited

U.S. PATENT DOCUMENTS

| | | | | |
|---|---|---|---|---|
| 9,657,928 | B1 * | 5/2017 | Jacobson | F21V 23/04 |
| 2010/0090613 | A1 * | 4/2010 | Spartano | H05B 45/46 315/287 |
| 2010/0176750 | A1 * | 7/2010 | West | F21V 23/0414 315/362 |
| 2014/0043302 | A1 * | 2/2014 | Barnes | G09G 5/003 345/184 |
| 2014/0254197 | A1 * | 9/2014 | Wang | F21V 21/0832 362/612 |
| 2016/0050736 | A1 * | 2/2016 | Hoang | F21V 23/0464 315/151 |
| 2017/0127789 | A1 * | 5/2017 | Huang | H05B 45/10 |
| 2019/0191512 | A1 * | 6/2019 | Zeng | F21S 8/026 |

* cited by examiner

*Primary Examiner* — Tracie Y Green

(74) *Attorney, Agent, or Firm* — Chun-Ming Shih; Lanway IPR Services

(57) ABSTRACT

A lighting apparatus includes a light source, a driver module, a light passing cover, a main housing and a manual switch module. The light source includes a LED module. The driver module converts an external power source to a driving current supplied to the LED module. The main housing includes a light source holder for disposing the light source, a driver holder for disposing the driver module, and a light passing holder for disposing the light passing cover for a light of the LED module emitting through the light passing cover. The manual switch module is attached to an external side of main housing. The manual switch module includes a switch housing, a circuit board and a manual switch.

19 Claims, 10 Drawing Sheets

LIGHTING APPARATUS WITH MANUAL SWITCH

FIELD

The present invention is related to a lighting apparatus, and more particularly related to a lighting apparatus with a manual switch.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

When more and more light devices are developed, people want more functions and flexibilities to fit various needs. The same light device may be expected to have multiple functions that may be dynamically selected and configured during usage. For example, users may change the setting before installing the light device to their house or office. People may also adjust the setting later depending on different needs.

It is therefore beneficial to design light devices with more convenient adjustment tools to provide more flexibility.

SUMMARY

In some embodiments, a lighting apparatus, includes a light source, a driver module, a light passing cover, a main housing and a manual switch module.

The light source includes a LED module. For example, the light source may include a light source plate with conductive paths for electrically connecting one or multiple LED modules in series, in parallel or in series and in parallel. Each LED module may have one or multiple LED chips, which may be covered by corresponding fluorescent layers. More than one LED chips may be integrated in one LED module for mixing a desired optical parameter, e.g. a requested color temperature, a color or other parameters.

Each LED module may be integrated as a package. In addition, to change light paths of the LED module, a lens for condensing or diffusing a light of the LED module may be added to the LED module. For example, to provide a soften light, a diffusion lens may be attached above the LED chip of the LED module for diffusing light to wider directions.

The driver module converts an external power source to a driving current supplied to the LED module. The driver module may include a rectifier for rectifying an external AC current. Filter and PWM (pulse width modulation) circuits may be integrated in the driver module for providing a stable and controllable driving current. By controlling a duty cycle, for example, the driver module may adjust light intensity of the LED module or control multiple LED chips of one or more LED modules to mix a desired optical parameter.

The main housing includes a light source holder for disposing the light source, a driver holder for disposing the driver module, and a light passing holder for disposing the light passing cover for a light of the LED module emitting through the light passing cover. Heat sink unit may be attached to the light source holder for carrying heat away from the LED module.

The manual switch module is attached to an external side of main housing. The manual switch module includes a switch housing, a circuit board and a manual switch. The manual switch is exposed outside the main housing for a user to operate. The circuit board has an actuation area corresponding to the manual switch. When the manual switch is operated by the user, the actuation area has an electronic status change. A controller of the circuit board converts the electronic status change to an operation command sent to the driver module for adjusting controlling of the LED module.

For example, the controller is a micro controller or a processor for executing stored codes for performing necessary calculation and signal conversion of the actuation area.

In some embodiments, the manual switch module may also include an elastic layer disposed between the manual switch and the actuation area.

In some embodiments, the elastic layer may include a conductive foam. When the manual switch presses the conductive foam, the conductive foam changes an electronic status on the actuation area and provides elastic force for recovering the manual switch back to an original position when the user releases the manual switch.

In some embodiments, the manual switch is a button for the user to press toward the actuation area.

In some embodiments, the circuit board has a wireless circuit sending the electronic status change to the driver module via a wireless transmission.

In some embodiments, the switch module has a non-volatile memory for storing a setting by the user.

In some embodiments, the switch module has a battery for supplying power to the circuit board.

In some embodiments, the manual switch module sends the electronic status change to other lighting apparatuses in addition to the lighting apparatus to control said other lighting apparatuses. Specifically, there may be other lighting apparatuses connecting to the manual switch module wirelessly for receiving a setting of the manual switch module.

This is particularly convenient in a place installed with multiple lighting apparatuses. The user only needs to control one manual switch module to activate the changing to multiple lighting apparatuses. Such function may be disabled or enabled by a jumper, an operation pattern, e.g. two clicks instead of one click, or configuration in the factory.

In some embodiments, the manual switch module is detachable from the main housing to be used as a remote control. The manual switch module, for example, may have a magnet unit for attaching to the main housing of the lighting apparatus and may be easily removed from the lighting apparatus and easily attached back to the main housing of the lighting apparatus.

In some embodiments, the switch housing has an installation part for installing to an installation base of the main housing.

In some embodiments, the installation base has a plugging slot for receiving the installation part to plug in.

In some embodiments, the main housing has a conductive path electrically connecting the driver module to the circuit board of the manual switch module.

In some embodiments, the installation part of the manual switch module has a first shape matching and engaging a second shape of the installation base of the main housing. For example, the installation base may have a convex bar or a groove for matching a concave structure or a protruding block of the installation part of the manual switch module.

In some embodiments, the installation part of the manual switch module is disposed inside the main housing and the main housing has switch opening for exposing the manual switch to be touched by the user.

In some embodiments, the switch housing has a sliding track for inserting the circuit board to align the actuation area with the manual switch. The sliding track may have a fixing hook when the circuit board is sliding to a predetermined position. Electrical electrodes may be disposed on the switch housing for routing and electrically connecting components of the circuit board to other components, like the driver module.

In some embodiments, the switch housing has a slot for inserting a function card with an expanding function added to the driver module. For example, a smoke detection module, a speaker, a wireless card, or other circuit component may be integrated with the driver module to enhance functions of the lighting apparatus.

Such added function may be optional. In other words, the driver module may detect automatically whether the function card exists to adjust working process of the driver module.

In some embodiments, the actuation area has a sensor array for sensing pressed positions of manual switch and the controller maps a series of the pressed positions as a gesture. For example, the sensor array may include multiple conductive lines arranged in cross pattern for detecting conductor or resistance value for different positions.

In some embodiments, the main housing has a lateral wall surrounding the light passing cover and the manual switch is disposed on the lateral wall of the main housing.

In some embodiments, the manual switch emits a status light controlled by the circuit board for indicating a status of the manual switch module.

In some embodiments, the manual switch emits a status light controlled by the driver module for indicating a status of the lighting apparatus.

DETAILED DESCRIPTION

Figure 2:
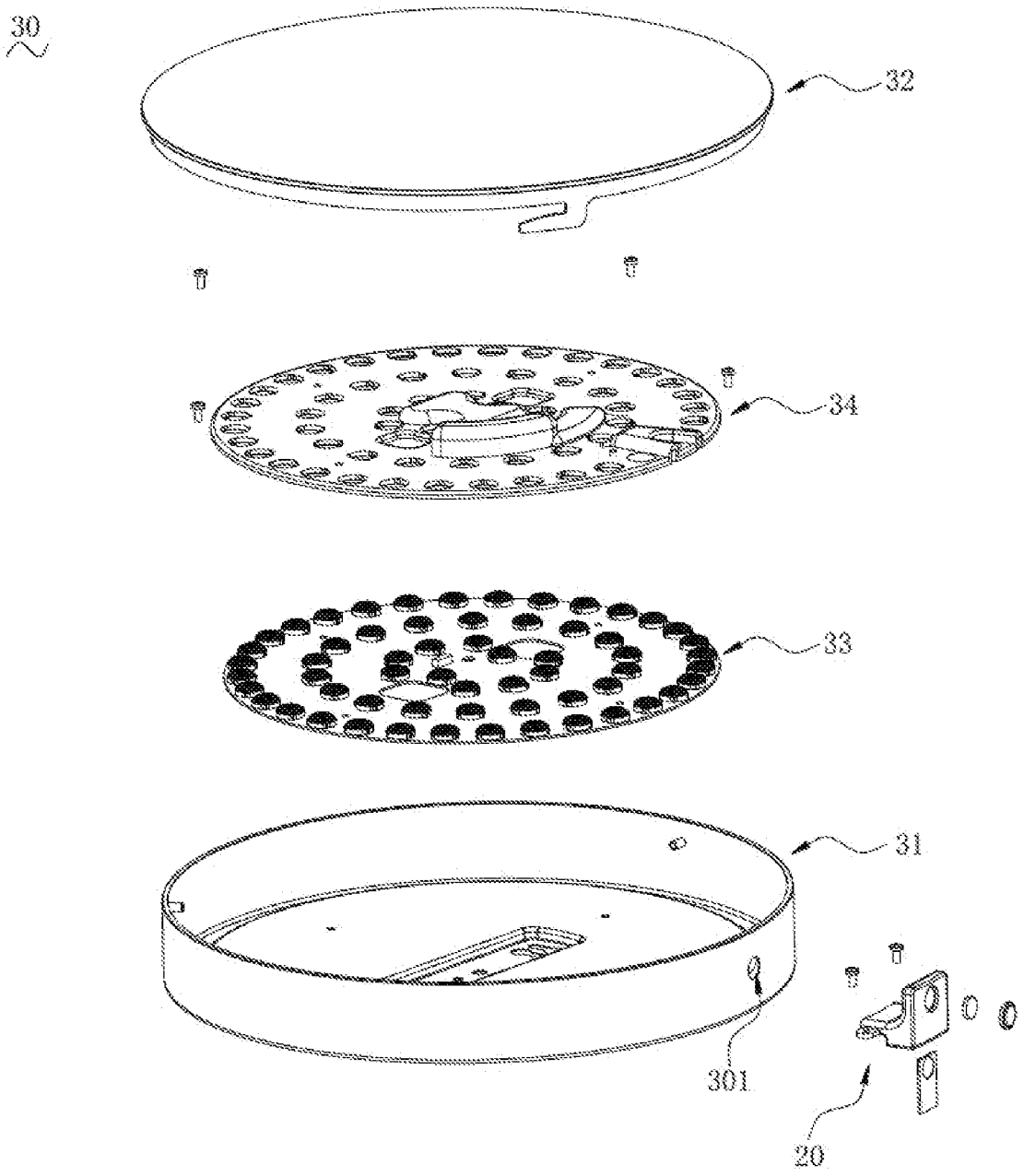
FIG. 2 illustrates an exploded view of a lighting apparatus.

In FIG. 2, a lighting apparatus includes a light source 33, a driver module 331, a light passing cover 32, a main housing 31 and a manual switch module 20.

The light source 33 includes a LED module 332, e.g. DOB (Device on Board) light source. For example, the light source 331 may include a light source plate 333 with conductive paths for electrically connecting one or multiple LED modules in series, in parallel or in series and in parallel. Each LED module may have one or multiple LED chips, which may be covered by corresponding fluorescent layers. More than one LED chips may be integrated in one LED module for mixing a desired optical parameter, e.g. a requested color temperature, a color or other parameters.

Each LED module may be integrated as a package. In addition, to change light paths of the LED module, a lens for condensing or diffusing a light of the LED module may be added to the LED module. For example, to provide a soften light, a diffusion lens may be attached above the LED chip of the LED module for diffusing light to wider directions.

The driver module 331 connects to an external power source 334 and converts the external power source 334 to a driving current (invisible but should be understood for persons of ordinary skill in the art with reference to related components) supplied to the LED module 332. The driver module 331 may include a rectifier for rectifying an external AC current. Filter and PWM (pulse width modulation) circuits may be integrated in the driver module for providing a stable and controllable driving current. By controlling a duty cycle, for example, the driver module may adjust light intensity of the LED module or control multiple LED chips of one or more LED modules to mix a desired optical parameter.

The main housing 31 includes a light source holder 3101 for disposing the light source 33, a driver holder 3103 for disposing the driver module 331, and a light passing holder 3102 for disposing the light passing cover 32 for a light of the LED module emitting through the light passing cover 32. Heat sink unit may be attached to the light source holder for carrying heat away from the LED module. In this example, the driver module 331 is integrated to the light source 33 but may be designed as a separate component held by the main housing, which may be easily understood by persons skilled in the art without specific drawing brevity.

In this example, there is a transparent cover 34 covering the light source 34. Lens and other components may be disposed on the transparent cover 34 for redirecting light or protecting the components of the light source 33.

The manual switch module 20 is attached to an external side 3105 of main housing 31.

Figure 1:
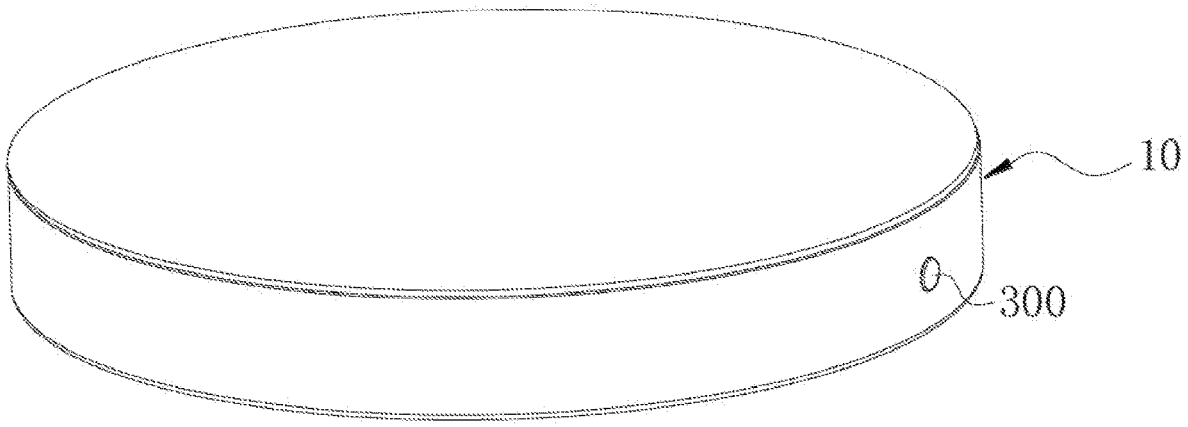
FIG. 1 illustrates a first embodiment of a lighting apparatus.

Please refer to FIG. 1. The main housing 31 has a manual switch 300 exposed on a lateral wall of the main housing 31.

Figure 3:
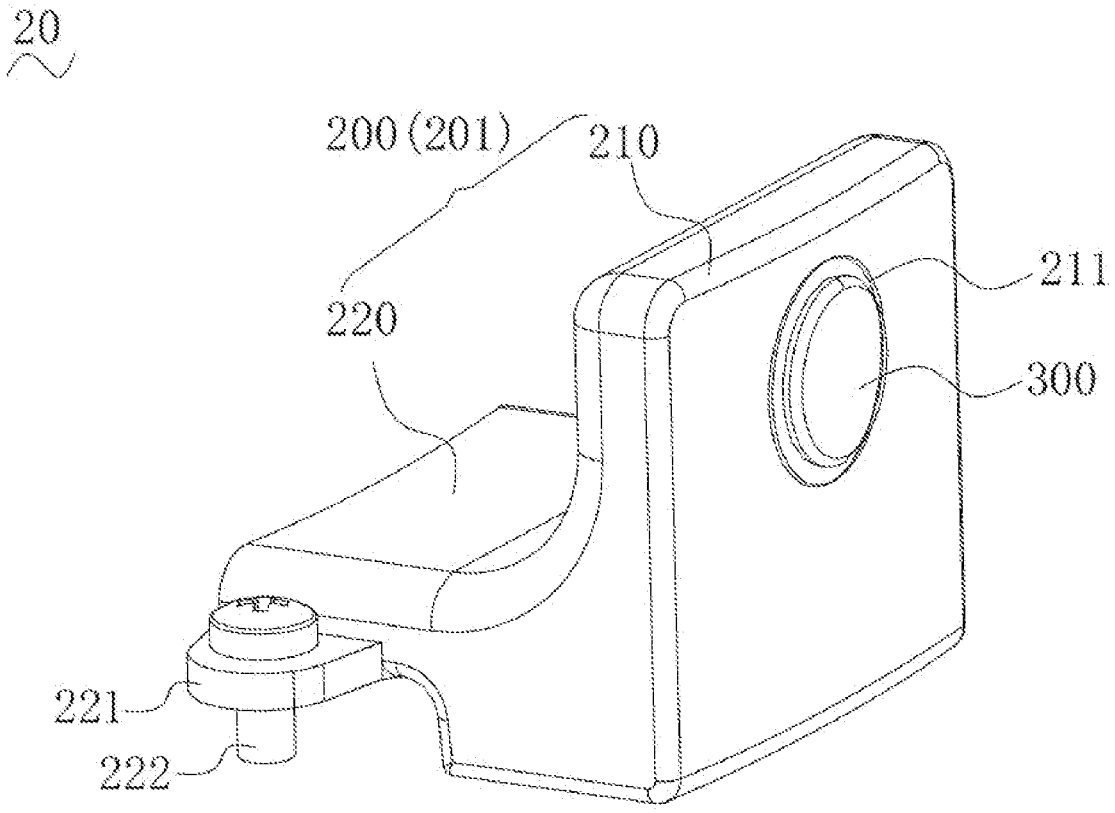
FIG. 3 illustrates an example of a manual switch module.
Figure 4:
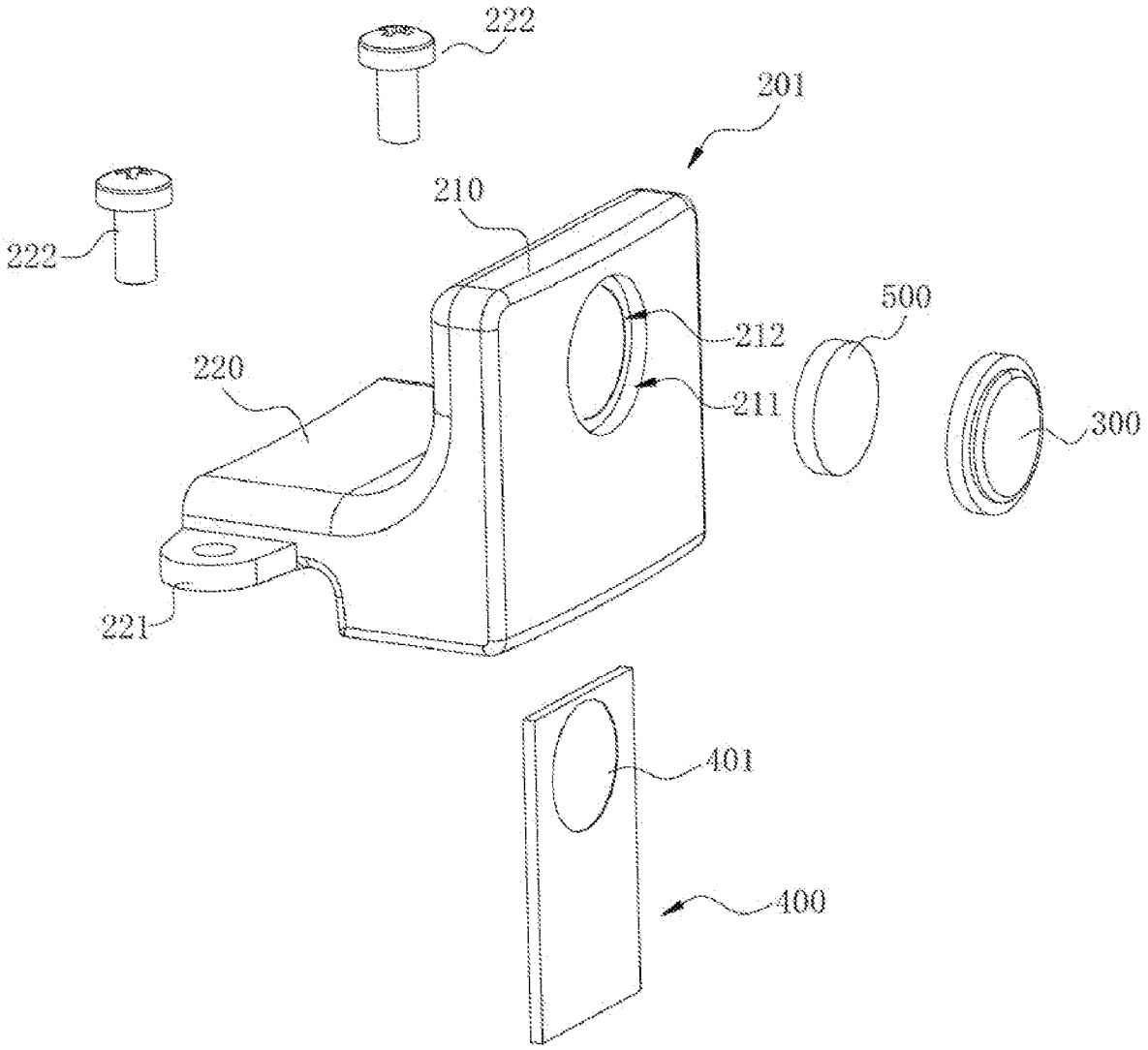
FIG. 4 illustrates an exploded view of a manual switch module.

Please refer to FIG. 3 and FIG. 4. FIG. 3 shows an assembled view and FIG. 4 shows an exploded view. The manual switch module 20 includes a switch housing 200, a circuit board 400 and a manual switch 300. The manual switch 300 is exposed outside the main housing as shown in FIG. 1 for a user to operate. The circuit board 400 has an actuation area 401 corresponding to the manual switch 300. When the manual switch 300 is operated by the user, the actuation area 401 has an electronic status change. A controller 402 of the circuit board 400 converts the electronic status change to an operation command sent to the driver module shown in FIG. 1 for adjusting controlling of the LED module.

For example, the controller 402 is a micro controller or a processor for executing stored codes for performing necessary calculation and signal conversion of the actuation area.

In some embodiments, the manual switch module 20 may also include an elastic layer disposed between the manual switch and the actuation area. In FIG. 4, the elastic layer may include a conductive foam 500, but the elastic layer may also be made of other elastic structure like spring, rubber or other components.

When the manual switch 300 presses the conductive foam 500, the conductive foam 500 changes an electronic status on the actuation area 401 and provides elastic force for recovering the manual switch 300 back to an original position when the user releases the manual switch 300.

In some embodiments, the manual switch is a button for the user to press toward the actuation area.

In FIG. 4, the circuit board has a wireless circuit 403 sending the electronic status change to the driver module via a wireless transmission.

In FIG. 4, the switch module has a non-volatile memory 404 for storing a setting by the user. In such way, the setting may be set, if there is a battery for the manual switch module, even before the lighting apparatus is installed on a desired place for getting electricity supply.

In FIG. 4, the switch module has a battery 406 for supplying power to the circuit board.

In FIG. 4, the manual switch module sends the electronic status change to other lighting apparatuses in addition to the lighting apparatus to control said other lighting apparatuses. Specifically, there may be other lighting apparatuses 688 connecting to the manual switch module wirelessly for receiving a setting of the manual switch module.

This is particularly convenient in a place installed with multiple lighting apparatuses. The user only needs to control one manual switch module to activate the changing to multiple lighting apparatuses. Such function may be disabled or enabled by a jumper, an operation pattern, e.g. two clicks instead of one click, or configuration in the factory.

In some embodiments, the manual switch module is detachable from the main housing to be used as a remote control. The manual switch module, for example, may have a magnet unit for attaching to the main housing of the lighting apparatus and may be easily removed from the lighting apparatus and easily attached back to the main housing of the lighting apparatus.

In some embodiments, the switch housing has an installation part 220 in FIG. 4 for installing to an installation base 3108 of the main housing 31 in FIG. 2.

In some embodiments, the installation base has a plugging slot for receiving the installation part to plug in. Such plugging slot may be a hole with certain structure for guiding and aligning connection of the two components. There are various ways for implementing this feature and therefore is not specifically illustrated in the drawings for brevity.

In FIG. 2, the main housing has a conductive path 3109 electrically connecting the driver module 331 to the circuit board of the manual switch module 20.

In some embodiments, the installation part of the manual switch module has a first shape 2201 matching and engaging a second shape of the installation base 3108 of the main housing. For example, the installation base may have a convex bar or a groove for matching a concave structure or a protruding block of the installation part of the manual switch module. Screw holes 221, screws 22 may be used for fixing components together. The switch housing 200 in FIG. 3 may have a vertical part 210 for installing the circuit board. The vertical part 210 and the installation part 220 are arranged like a L shape.

In FIG. 2, the installation part of the manual switch module is disposed inside the main housing 31 and the main housing 31 has switch opening 301 for exposing the manual switch to be touched by the user.

Figure 5:
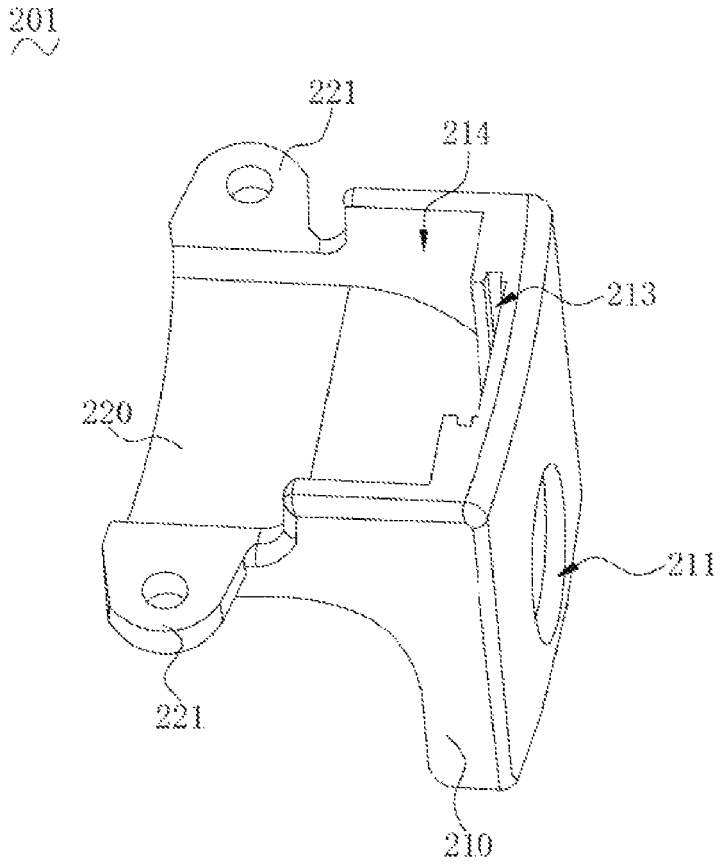
FIG. 5 illustrates another view of the manual switch module.

In FIG. 5, the switch housing has a sliding track 213 for inserting the circuit board to align the actuation area with the manual switch. The sliding track may have a fixing hook when the circuit board is sliding to a predetermined position. Electrical electrodes may be disposed on the switch housing for routing and electrically connecting components of the circuit board to other components, like the driver module.

Figure 6:
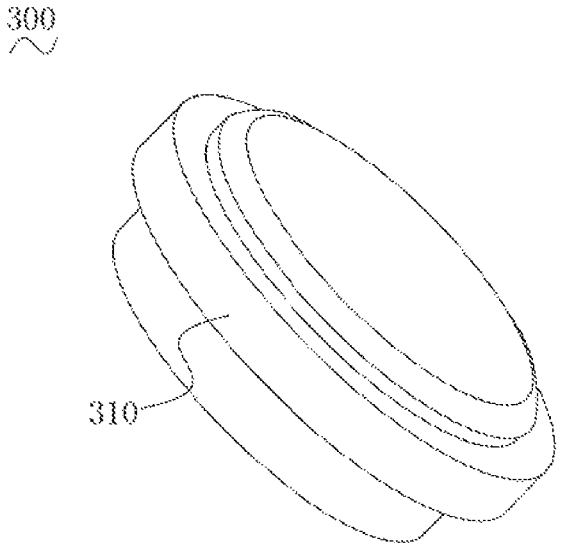
FIG. 6 illustrates another embodiment of a lighting apparatus.

FIG. 6 shows the manual switch 300 having a stop structure 310 to be pressed but kept at a desired position.

In FIG. 5, the switch housing has a slot for inserting a function card 701 with an expanding function added to the driver module. For example, a smoke detection module, a speaker, a wireless card, or other circuit component may be integrated with the driver module to enhance functions of the lighting apparatus.

Such added function may be optional. In other words, the driver module may detect automatically whether the function card exists to adjust working process of the driver module.

In FIG. 4, the actuation area has a sensor array 4011 for sensing pressed positions of manual switch and the controller maps a series of the pressed positions as a gesture. For example, the sensor array 4011 may include multiple conductive lines arranged in cross pattern for detecting conductor or resistance value for different positions.

In FIG. 1, the main housing has a lateral wall 3188 surrounding the light passing cover and the manual switch is disposed on the lateral wall of the main housing.

In FIG. 3, the manual switch emits a status light 377 controlled by the circuit board for indicating a status of the manual switch module.

In FIG. 3, the manual switch emits a status light 377 controlled by the driver module for indicating a status of the lighting apparatus.

Please refer to FIG. 7, FIG. 8, FIG. 9 and FIG. 10.

Figure 7:
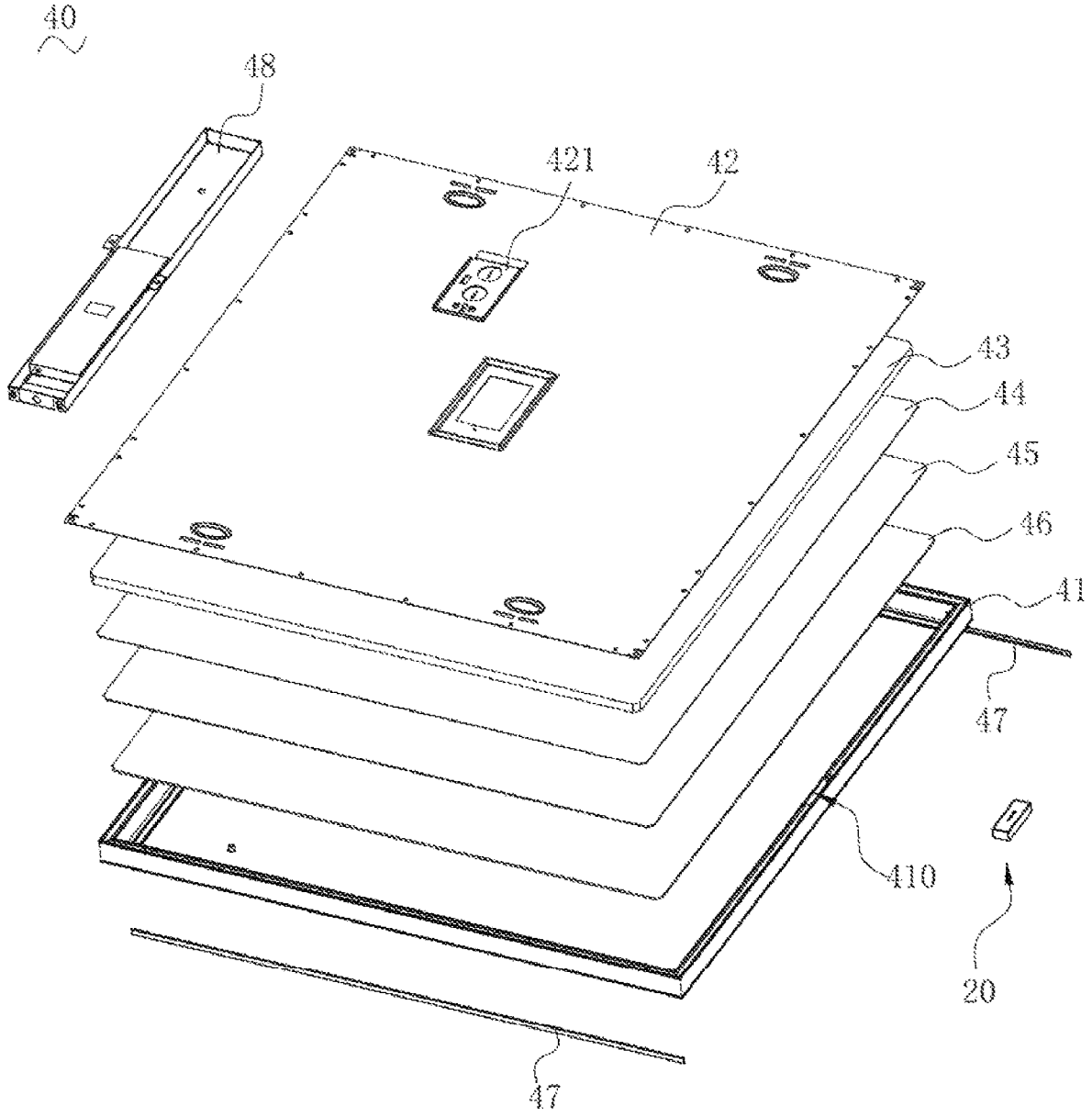
FIG. 7 illustrates a button example.

FIG. 7 shows an exploded view of a lighting apparatus 40. In FIG. 7, the lighting apparatus 40 has a manual switch module 20 to be installed to an installation base 410.

The lighting apparatus 40 has light bars 47 arranged on a peripheral side, emitting light directed by the light guide plate 45. There is a diffusion plate 46 for soften the light.

There is a reflective layer 44 for reflecting light to increase light efficiency.

There is a foam layer 43 to enhance fixing of components. A frame 41 is used for holding the components. There is a back cover 42. There is also a driver module 48 disposed on a back side or a lateral side of the lighting apparatus.

Figure 8:
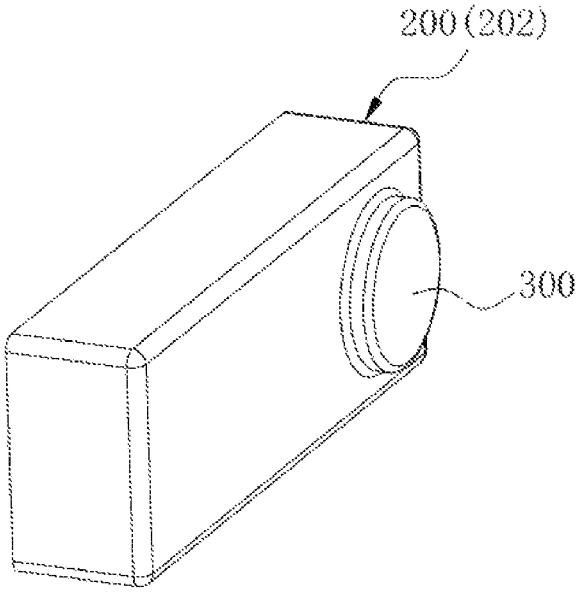
FIG. 8 illustrates another example of a manual switch module.

FIG. 8 shows a manual switch 300. In this example, the switching housing of the manual switch module 200 is a box shape, unlike the L-shape in previous example.

Figure 9:
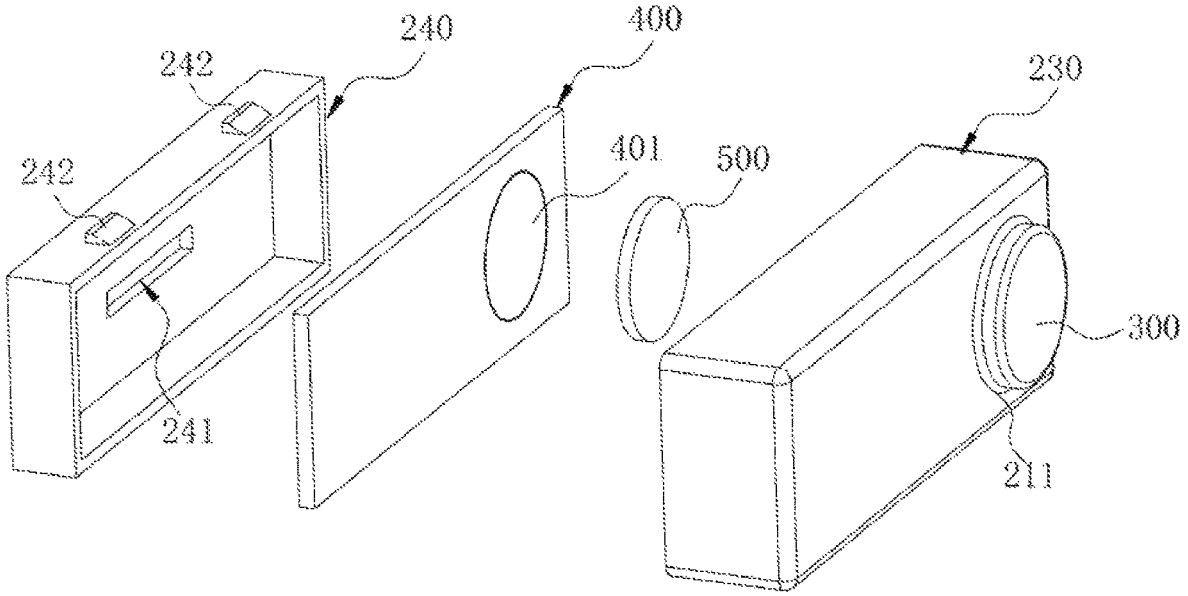
FIG. 9 illustrates an exploded view of a manual switch module.

FIG. 9 shows that there are buckle structures 242 for fixing a bottom cover 240 to a top cover 230. There is a wire hole for passing a wire connecting to a driver module. The circuit board 400 has an actuation area 401 with a conductive foam 500 corresponding to a manual switch 300 via a switch hole 211.

Figure 10:
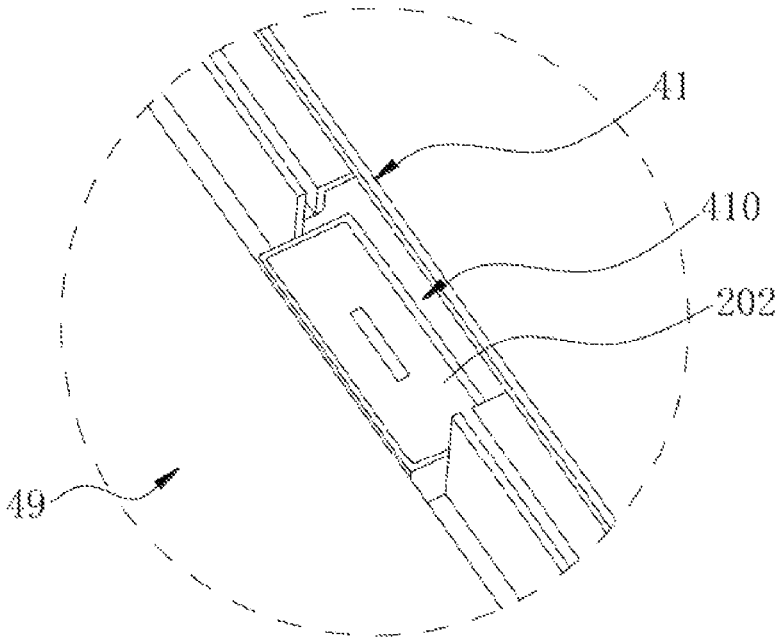
FIG. 10 illustrates an installation base for installing the manual switch module.

FIG. 10 shows that the frame 41 has the installation base 410 with a plugging slot for installing the manual switch module.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source comprising a LED module;

a driver module converting an external power source to a driving current supplied to the LED module;

a light passing cover;

a main housing comprising a light source holder for disposing the light source, a driver holder for disposing the driver module, and a light passing holder for disposing the light passing cover for a light of the LED module emitting through the light passing cover; and a manual switch module attached to an external side of main housing, the manual switch module comprising a switch housing, a circuit board and a manual switch, wherein the manual switch is exposed outside the main housing for a user to operate, the circuit board has an actuation area corresponding to the manual switch, when the manual switch is operated by the user, the actuation area has an electronic status change, a controller of the circuit board converts the electronic status change to an operation command sent to the driver module for adjusting controlling of the LED module, wherein the switch housing has an installation part for installing to an installation base of the main housing.

2. The lighting apparatus of claim 1, wherein the manual switch module further having an elastic layer disposed between the manual switch and the actuation area.

3. The lighting apparatus of claim 2, wherein the elastic layer comprises a conductive foam.

4. The lighting apparatus of claim 2, wherein the manual switch is a button for the user to press toward the actuation area.

5. The lighting apparatus of claim 1, wherein the circuit board has a wireless circuit sending the electronic status change to the driver module via a wireless transmission.

6. The lighting apparatus of claim 5, wherein the switch module has a non-volatile memory for storing a setting by the user.

7. The lighting apparatus of claim 5, wherein the switch module has a battery for supplying power to the circuit board.

8. The lighting apparatus of claim 5, wherein the manual switch module sends the electronic status change to other lighting apparatuses in addition to the lighting apparatus to control said other lighting apparatuses.

9. The lighting apparatus of claim 5, wherein the manual switch module is detachable from the main housing to be used as a remote control.

10. The lighting apparatus of claim 1, wherein the installation base has a plugging slot for receiving the installation part to plug in.

11. The lighting apparatus of claim 10, wherein the main housing has a conductive path electrically connecting the driver module to the circuit board of the manual switch module.

12. The lighting apparatus of claim 1, wherein the installation part of the manual switch module has a first shape matching and engaging a second shape fo the installation base of the main housing.

13. The lighting apparatus of claim 12, wherein the installation part of the manual switch module is disposed inside the main housing and the main housing has switch opening for exposing the manual switch to be touched by the user.

14. The lighting apparatus of claim 1, wherein the switch housing has a sliding track for inserting the circuit board to align the actuation area with the manual switch.

15. The lighting apparatus of claim 1, wherein the switch housing has a slot for inserting a function card with an expanding function added to the driver module.

16. The lighting apparatus of claim 1, wherein the actuation area has a sensor array for sensing pressed positions of manual switch and the controller maps a series of the pressed positions as a gesture.

17. The lighting apparatus of claim 1, wherein the main housing has a lateral wall surrounding the light passing cover and the manual switch is disposed on the lateral wall of the main housing.

18. The lighting apparatus of claim 1, wherein the manual switch emits a status light controlled by the circuit board for indicating a status of the manual switch module.

19. The lighting apparatus of claim 1, wherein the manual switch emits a status light controlled by the driver module for indicating a status of the lighting apparatus.

* * * * *